US005163364A

United States Patent [19]

Bubik et al.

[11] Patent Number: 5,163,364

[45] Date of Patent: Nov. 17, 1992

[54] METHOD FOR CALENDERING A PAPER OR CARDBOARD WEB

[75] Inventors: Alfred Bubik; Hans Dahl, both of Ravensburg; Rüdiger Kurtz, Immenstaad; Herbert Holik, Ravensburg; Peter Mirsberger, Weingarten; Harald Hess, Grünkraut, all of Fed. Rep. of Germany

[73] Assignee: Sulzer-Escher Wyss GmbH, Reavesburg, Fed. Rep. of Germany

[21] Appl. No.: 423,975

[22] Filed: Oct. 19, 1989

[30] Foreign Application Priority Data

Oct. 31, 1988 [CH] Switzerland ..... 04045/88

[51] Int. Cl.[5] ..... B30B 15/34; B30B 5/04; D21G 1/00

[52] U.S. Cl. ..... 100/38; 100/35; 100/73; 100/93 P; 100/93 RP; 100/153; 162/206; 162/207

[58] Field of Search ..... 100/93 P, 93 RP, 151, 100/153, 37, 38, 35, 73-75, 156, 161; 162/205, 206, 207, 359, 360.1

[56] References Cited

U.S. PATENT DOCUMENTS

| | | | |
|---|---|---|---|
| 1,086,097 | 2/1914 | Swift, Jr. | 100/93 RP |
| 1,862,656 | 6/1932 | Boyer | 100/93 RP X |
| 3,286,360 | 11/1966 | Walker | 100/153 X |
| 3,354,035 | 11/1967 | Gottwald et al. | 100/93 RP X |
| 3,563,166 | 2/1971 | Bajak et al. | 100/153 |
| 3,604,344 | 9/1971 | Orstam | 100/93 RP X |
| 3,783,097 | 1/1974 | Justus | 100/151 X |
| 4,496,429 | 1/1985 | Salminen et al. | 100/153 X |
| 4,704,191 | 11/1987 | Wedel | 100/153 X |
| 4,850,848 | 7/1989 | Greten et al. | 100/151 X |

FOREIGN PATENT DOCUMENTS 0141614 5/1985 European Pat. Off. .

*Primary Examiner*—Harvey C. Hornsby
*Assistant Examiner*—Stephen F. Gerrity
*Attorney, Agent, or Firm*—Greenfield & Sacks

[57] ABSTRACT

Calendering takes place in a calendering zone which operates under pressure with application of temperature and moisture. The desired smoothness is achieved with a correspondingly long dwell time of the material web in a correspondingly long calendering zone in view of the speed of web travel. A web which is still wet is guided between parallel heatable surfaces which are arranged on both sides of the web and face each other through the web and can each be pressed against the web. The surfaces are designed to form and hold a given precise contour of the calendering zone over its full length. One surface is constructed e.g. as a casing of a heated roller and the second surface is constructed as an endless flexible belt which can be pressed in a direction towards the roller casing by means of a concave supporting element. If wished, the web can be calendered on both sides with the method.

20 Claims, 1 Drawing Sheet

METHOD FOR CALENDERING A PAPER OR CARDBOARD WEB

BACKGROUND OF THE INVENTION

1. Field of the Invention

The invention concerns a method for calendering a paper or cardboard web.

2. Discussion of the Related Art

A method of this kind is known from European patent application No. 0 141 614 A2. A long calendering zone is formed between a smooth casing of a heated roller and a belt which partly wraps around the casing. An as yet uncalendered paper or cardboard web is more or less dried or wetted with respect to the web thickness and then the wetter side of the web is pressed against the casing of the heated roller by means of the belt. One surface of the web is thus calendered during the dwell time in the calendering zone. The desired calendering process thus takes place on only one side of the web. During the calendering process, the application of temperature and pressure in the calendering zone is complex and difficult to monitor.

An object of the invention is to provide a method for calendering a paper or cardboard web, in which a web which is still wet can be calendered as desired at any given time without first having to produce an asymmetrical moisture profile with respect to the web thickness in an elaborate way. At the same time the application of pressure and temperature during the calendering process should be easy to survey and regulate.

SUMMARY OF THE INVENTION

According to the invention, there is provided a method for calendering a paper or cardboard web in a calendering zone during a period of the calendering process predetermined by the dwell time of the web in the calendering zone, wherein the calendering zone operates under pressure with application of temperature and moisture. The desired smoothness is achieved with a correspondingly long calendering zone wherein a web which is still wet is guided between parallel heatable surfaces which are arranged on both sides of the web, face the web, and can each be pressed against the web. The parallel heatable surfaces are designed to form and hold a predetermined, precise contour of the calendering zone over its full length.

As a relatively low pressure can be set in the long calendering zone by means of the supporting elements, pressure peaks are largely avoided at points of higher basis weight of the paper or cardboard web and better quality of the product is obtained. Due to the relatively long calendering zone and fairly long dwell time of the material in the calendering zone, the desired calendering values on boths sides of the web can be achieved even at higher web speeds. In particular the application of lower pressures and high temperatures of the pressable surfaces in conjunction with higher web moisture contents promote calendering which spares the web volume, which is desired here.

BRIEF DESCRIPTION OF THE DRAWINGS

Below, the subject of the invention is described in more detail and explained. The description relates to drawings which show.

Figure 1:
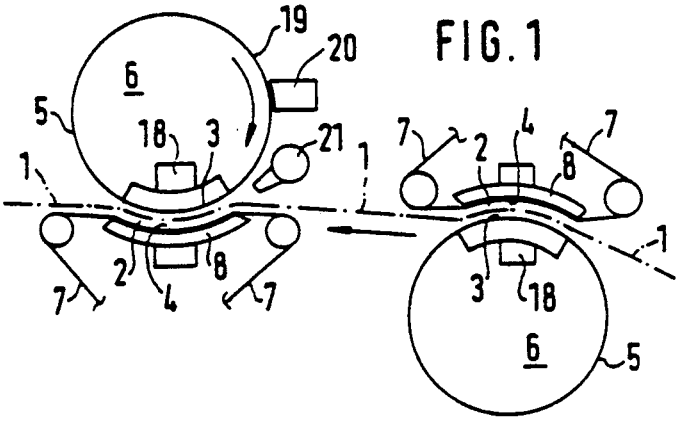
FIG. 1, a first practical example in a device provided therefor.

The method for calendering a paper or cardboard web 1 moving in the direction of web travel (arrow) is carried out in at least one calendering zone 2 for a precise duration of the calendering process. The material is located in the calendering zone 2 during a dwell time which can be calculated from the length of the calendering zone 2 and the speed of web travel. During this dwell time, which is extended according to the length of the calendering zone, the material to be calendered i.e. the paper or cardboard web is subjected to a variable pressure in the calendering zone 2. In an advantageous choice of conditions the pressure can be relatively low. Heat is applied via the surfaces 3 and 4 arranged on both sides of the web 1, which together with the moisture of the web 1 leads to the desired calendering of the web. The conditions can be selected advantageously so that no overpressed spots arise in a web of uneven basis weight. This takes place in the extended calendering zone 2 which is long enough to achieve an adequate dwell time of the material in it, in view of the web speed to be run. The calendering zone 2 must be so long that the desired calendering process can be completed during the dwell time and the desired smoothness achieved. In general, the higher the speed of web travel is to be, the longer the length of the calendering zone must be.

The application of pressure, temperature, moisture and the length of the calendering zone are selected according to the smoothness that is to be achieved on the selected material and at a selected web speed.

A device is shown schematically in the drawings as an example of different versions which serve to carry out the method according to the invention. The device has a calendering zone 2 which is formed between two surfaces 3 and 4 pointing towards each other. The surfaces 3 and 4 run parallel to each other, and are heatable and adjustable relative to each other, so that the web 1 can be subjected to a precise contact pressure. The surfaces 3 and 4 extend over a longitudinal section in the direction of web travel, which is indicated with an arrow.

According to the practical example as in FIG. 1, one surface 3 is a casing 5 of a roller 6. The second surface 4 is formed by means of an endless flexible belt 7. The belt 7 is supported in a direction towards the roller casing 5 by means of a supporting element 8 to which pressure can be applied. The latter comprises a supporting surface which is concave towards the belt 7 and which is of complementary construction to the radius of the roller casing 5. The casing 5 of the roller 6 and the belt 7 can be driven at the same speed as the speed of travel of the web 1. If it is technologically desired, different speeds may be used too.

Instead of the casing 5 of the roller 6, a flexible belt 19 may be used which is guided in a known manner (not shown) over rollers and formed into a convex shape in the calendering zone 2 by means of a supporting element 18. The convex supporting surface is complementary to the opposed concave surface of supporting element 8. A metal belt has the advantage of being easy to heat. Heating, e.g. induction heating, means for the belt 19 are shown in FIG. 1, and marked 20. Another device which can be used e.g. for heating with steam or hot air is also shown in FIG. 1 and marked 21. Heating means 21 could be used advantageously, particularly if a non-metallic belt 19 were involved.

The pressure to be applied in the calendering zone 2 can be generated by varying the pressure in the pressure medium of the supporting element 8 or supporting elements 8 and 18. The surface temperature of the calendering surface is variable by means of devices 20 and 21. The moisture is determined by the dampness of the web 1 to be treated. The flexible belts are impermeable, and between the belt and the supporting surface of the supporting element is provided a liquid film which is created hydrostatically and/or hydrodynamically. This ensures low-friction running of the belt along the supporting surfaces. The temperature of the liquid could be adjusted for heating and for cooling. The supporting elements may be slide blocks known in the art, wherein a liquid would be introduced between the supporting surface and the belt. The supporting elements may also be hydrostatic supporting elements known in the art. Their pressure compartments could similarly be supplied with a heating or cooling liquid. With these supporting elements, therefore, both the pressure and the temperature in the calendering zone 2 can be adjusted as needed, and reduced if desired. If e.g. a calendering gap should not be enough or for each gap only one surface is heatable, it is an advantage to arrange 2 calendering zones one behind the other, approximately as shown in FIG. 1. If only one surface at any given time is heated in a calendering zone, then it is advisable to heat the opposed surfaces, so that the two sides of the web are calendered one after the other on one surface each.

Figure 2:
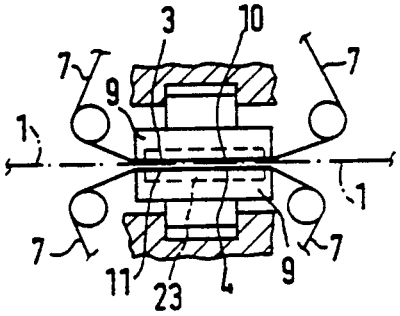
FIGS. 2 to 4, more practical examples.

Another embodiment provides endless flexible belts 7 which form the two surfaces 3 and 4. The belts are supported by supporting elements 9 which are adjustable relative to each other, see FIGS. 2 and 4, and which each comprise a plane supporting surface facing towards the belt 7. They can be pressed towards each other with precision in a known manner. Although hydrostatic supporting elements are shown here, slide blocks of the known kind can be used. Between each belt 7 and the plane supporting surface of the supporting element 9 is provided a liquid film which is created hydrostatically in the example according to FIG. 2. For this, the supporting element comprises pressure compartments 23 which open towards the belt 7 and which can admit a pressure medium, if necessary adjusted in temperature for heating or cooling. It is also possible to create the liquid film hydrodynamically, as might be the case e.g. in FIG. 3 on surface 3.

Figure 3:
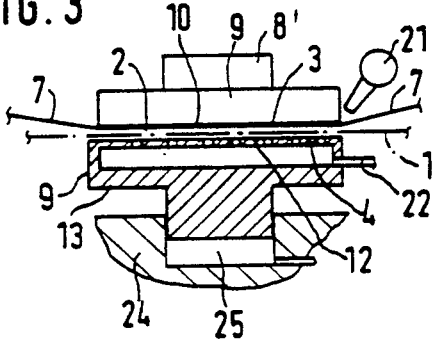
Figure 7:
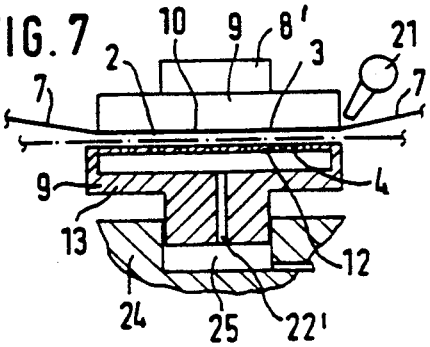
FIG. 7, another practical example with a supporting element.

In the device according to FIG. 3, one surface 3 is formed by an impermeable belt 7. The second surface 4 is formed by a wall 12 which lies adjacent to the web 1 and which defines a pressure chamber of a box-like supporting element 13 which is adjustable towards the web 1. The wall 12 is designed to allow passage of a gaseous medium which can be introduced under pressure via a pipe 22 into the pressure chamber under the wall. The supporting element is embedded in a carrier 24 after the fashion of a piston, wherein a pressure chamber 25 is provided which can admit a pressure medium for pressing the supporting element in a direction towards the web 1. Between the wall 12 and the web 1 is formed a gas layer which is created by the gaseous or vapour-like medium. Another modification is conceivable, in which the pressure chamber 25 is likewise supplied with a gaseous or vapour-like medium which can pass from there through one or more bores 22' to the pressure chamber under the wall 12 (FIG. 7).

Figure 5:
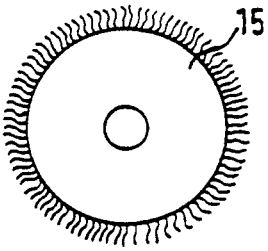
FIG. 5, a brush roller.
Figure 6:
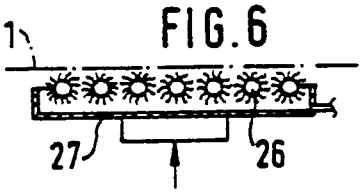
FIG. 6, a supporting frame with brush rollers.

In the method, brushing of the surface of the web might also be desired. This could be done with a brush roller 15, FIG. 5, which could be used e.g. instead of roller 6 which is shown in FIG. 1. If this brush roller is split perpendicularly to the direction of paper travel and the parts are driven at different speeds, control of the gloss/smoothness profile is advantageously possible as a result. Another advantageous embodiment is offered by use of a frame which is fitted with brush rollers 26 and forms at least one of the surfaces 3 or 4. This frame forms part of a box-like supporting element 27 which can be pressed against a web and in which it defines a pressure chamber which can admit a gaseous medium, e.g. steam. The medium penetrates during operation through the frame to the adjoining surface of the web 1. The brushes can be driven at a speed different to the web speed. If brushes arranged perpendicularly to the direction of web travel and shorter than the web width are used, then it is advantageous to arrange brushes one behind the other with a lateral offset to avoid streaks. Here too, advantages due to different speeds of the rollers are conceivable.

Of use in paper technology could be a supporting element similar to the one described above, the frame of which is equipped with smooth rollers of smaller diameter.

Figure 4:
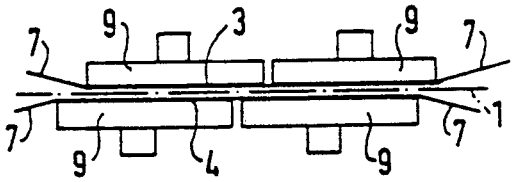

A longer calendering zone 2 can also be formed by means of two or more rows of supporting elements 9 arranged one behind the other in the direction of web travel, by which the belts 7 are supported as shown particularly clearly in FIG. 4.

Although, with the use of a relatively low pressure in the calendering zone according to the invention, the risk of overpressed spots in the web 1 is largely eliminated, in some cases it could be an advantage to make the flexible belt used out of soft material or to coat it with a softer flexible material, to create additional potential for the avoidance of local overpressing in the web.

What is claimed is:

1. A method for calendering a paper or cardboard web in a calendering zone having a length during a predetermined dwell time of the web in the calendering zone wherein the desired smoothness is achieved by controlling the length of the calendering zone, comprising the steps of;

providing a first set of parallel calendering surfaces which form a predetermined precise contour of the calendering zone over the length of the calendering zone;

forming one of said first set of parallel calendering surfaces by means of the surface of a roller having a radius;

forming another of said first set of parallel calendering surfaces by means of an endless flexible belt which is suported in a direction towards the roller surface by means of a supporting element provided with a concave supporting surface of complementary construction to the radius of the roller surface, wherein the surface of the roller and the flexible belt can be driven at a speed equal to the speed of web travel; heating the calendering surfaces to heat the calendering zone; guiding a still wetted web between the parallel calendering surfaces; and pressing the heated calendering surfaces towards each other to apply pressure to the web along the entire length of the calendering zone to calender at least one surface of the web.

2. The method of claim 1 further comprising a step of using an impermeable endless flexible belt and forming a liquid film between the belt and the surface of the supporting element facing towards the belt, which liquid film is created hydrodynamically and/or hydrostatically.

3. A method for calendering a paper or cardboard web in a calendering zone having a length wherein the desired smoothness of at least one surface of the web is achieved by passing the web through a single calendering zone and controlling the length of the calendering zone, comprising the steps of:

providing a first set of parallel calendering surfaces which form a predetermined precise contour of the calendering zone, which contour extends continuously over the length of the calendering zone;

heating the calendering surfaces to heat the calendering zone;

guiding a still wetted web between the parallel calendering surfaces; and pressing the heated calendering surfaces towards each other to apply pressure along the entire length of the calendering zone to at least one surface of the web.

4. The method of claim 3, further comprising a step of providing a second set of oppositely facing calendering surfaces for calendering another side of the web.

5. A method for calendering one side of a moist paper or cardboard web having two sides by passing the web through a single calendering zone having a length wherein a desired degree of smoothness is achieved by controlling the length of the calendering zone, comprising the steps of:

providing means for moving the web along a first direction through the calendering zone;

predetermined contour disposed on one side of the web, the bearing surface extending for substantially the length of the calendering zone along the first direction;

providing means defining a calendering surface disposed on another side of the web substantially opposite the means defining the bearing surface, the calendering surface comprising a single continuous surface extending for substantially the length of the calendering zone and having a contour which complements the predetermined contour of the bearing surface, the calendering surface further extending along the first direction for a length at least equal to a length of the bearing surface so that during calendering the web is not in contact with the bearing surface without being in contact with the calendering surface; and providing a first support element disposed adjacent to the means defining the calendering surface for directly urging the means defining the calendering surface towards the web and the means defining the bearing surface to apply pressure to the web along the entire length of the calendering zone.

6. A method for calendering a moist paper or cardboard web moving at a web speed in a web travel direction to a predetermined degree of smoothness, the method comprising the steps of:

A. providing a first calendering surface having a first continuous contour and a first length;

B. providing a second calendering surface having a second continuous contour which is parallel to the first contour and a second length substantially equal to the first length;

c. guiding the web between the first calendering surface and the second calendering surface;

D. heating the first calendering surface and the second calendering surface;

E. moving the first calendering surface and the second calendering surface towards each other to apply pressure to the web along the entire first length; and F. controlling the first and second calendering surface lengths so that the web is calendered to a predetermined degree of smoothness as it passes between the first and the second calendering surfaces.

7. A method according to claim 6 wherein step A comprises the steps of:

A1. forming a rigid surface into the first continuous contour; and

A2. moving the rigid surface in the web travel direction.

8. A method according to claim 7 wherein step A2 comprises the step of:

A2A. moving the rigid surface in the web travel direction at substantially the web speed.

9. A method according to claim 6 wherein step B comprises the steps of:

B1. forming a rigid support into the second continuous contour;

B2. positioning the rigid support facing the first continuous contour so that the first continuous contour and the second continuous contour are parallel;

B3. covering the second continuous contour with a flexible surface; and

B4. moving the flexible surface in the web travel direction.

10. A method according to claim 9 wherein step B4 comprises the step of:

B4A. moving the flexible surface in the web travel direction at substantially the web speed.

11. A method according to claim 10 wherein the first and second calendering surface lengths are selected based upon the speed of web travel, wherein a higher speed of web travel corresponds to a selecting of a longer length of the first and second calendering surfaces.

12. A method according to claim 6, wherein step A comprises the steps of:

A3. forming a rigid surface into the first continuous contour; and

A4. covering the first continuous contour with a first flexible surface; and

A4. moving the first flexible surface in the web travel direction.

13. A method according to claim 12 wherein step B comprises the steps of:

B5. forming a rigid support into the second continuous contour;

B6. positioning the rigid support facing the rigid surface so that the first continuous contour and the second continuous contour are parallel;

B7. covering the second continuous contour with a second flexible surface; and

B8. moving the second flexible surface in the web travel direction.

14. A method according to claim 13 wherein step B8 comprises the step of:

B8A. moving the second flexible surface in the web travel direction at substantially the web speed.

15. A method according to claim 12 wherein step A5comprises the step of:

A 5A. moving the first flexible surface in the web travel direction at substantially the web speed.

16. A method according to claim 6 wherein step A comprises the steps of:

A6. forming a rigid surface into the first continuous contour;

A7. forming a plurality of holes in the first continuous contour: and

A8. passing a gaseous medium through the holes.

17. A method according to claim 16 wherein step B comprises the steps of:

B9. forming a rigid support into the second continuous contour;

B10. positioning the rigid support facing the rigid surface so that the first continuous contour and the second continuous contour are parallel;

B11. covering the second continuous contour with a flexible surface: and

B12. moving the flexible surface in the web travel direction.

18. A method according to claim 17 wherein step B12 comprises the step of:

B12A. moving the flexible surface in the web travel direction at substantially the web speed.

19. A method according to claim 18 wherein the first and second calendering surface lengths are selected based upon the speed of web travel, wherein a higher speed of web travel corresponds to a selecting of a longer length of the first and second calendering surfaces.

20. A method according to claim 6 wherein the first and second calendering surface lengths are selected based upon the speed of web travel, wherein a higher speed of web travel corresponds to a selecting of a longer length of the first and second calendering surfaces.

* * * * *